US007404649B2

(12) United States Patent
Gosis et al.

(10) Patent No.: US 7,404,649 B2
(45) Date of Patent: Jul. 29, 2008

(54) LIGHTED WATER STREAM

(75) Inventors: Anatoly Gosis, Palatine, IL (US); David R. Nowak, Chicago, IL (US); Robert Dam, Aurora, IL (US); Abram Cervantes, Chicago, IL (US); Chuck Esposito, Elk Grove Village, IL (US)

(73) Assignee: Illinois Tool Works Inc., Glenview, IL (US)

( * ) Notice: Subject to any disclaimer, the term of this patent is extended or adjusted under 35 U.S.C. 154(b) by 7 days.

(21) Appl. No.: 11/524,098

(22) Filed: Sep. 20, 2006

(65) Prior Publication Data

US 2007/0139910 A1 Jun. 21, 2007

Related U.S. Application Data

(60) Provisional application No. 60/751,864, filed on Dec. 20, 2005.

(51) Int. Cl.
*F21V 33/00* (2006.01)

(52) U.S. Cl. ..... 362/101; 362/96; 362/318

(58) Field of Classification Search ..... 362/92, 362/96, 101, 318, 800; 239/18
See application file for complete search history.

(56) References Cited

U.S. PATENT DOCUMENTS 2,105,632 A * 1/1938 Bernesser ..... 362/96
2,731,747 A * 1/1956 Hazelroth et al. ..... 40/406
5,873,647 A * 2/1999 Kurtz et al. ..... 362/101
6,021,960 A * 2/2000 Kehat ..... 239/18
6,644,561 B1 * 11/2003 Daane ..... 239/18
7,008,073 B2 * 3/2006 Stuhlmacher, II ..... 362/101
7,114,821 B2 * 10/2006 Currie et al. ..... 362/101
7,182,477 B1 * 2/2007 Hartz ..... 362/96

FOREIGN PATENT DOCUMENTS

DE 4203107 A1 * 8/1993

OTHER PUBLICATIONS

Translation of previous cited DE4203107 in PTO-892 of Nov. 27, 2007.*

* cited by examiner

*Primary Examiner*—Y My Quach Lee
(74) *Attorney, Agent, or Firm*—Mark W. Croll; Paul F. Donovan

(57) ABSTRACT

The invention relates to devices configured and adapted to give a fluid stream the appearance of being lighted. Different colors of light, such as those provided from LEDs, may be used to generate an aesthetically pleasing effect of flowing colored fluid. In some embodiments, the fluid illumination may be accomplished by a light source directed towards a fluid stream from an external angle, for example. Alternatively, the light source may be pointed in the direction of the fluid stream, lighting it substantially internally. In yet other embodiments, the fluid illumination may be enhanced with the employment of reflective surfaces that bounce light around and through the fluid stream. To increase the appearance of being lighted, the reflective fluid surface area may be increased by generating turbulent flow. In certain embodiments, turbulent flow is achieved with the use of a separator to separate a single fluid stream into a plurality of micro-streams.

7 Claims, 4 Drawing Sheets

LIGHTED WATER STREAM

CROSS REFERENCE TO RELATED APPLICATIONS

This Non-Provisional Application claims benefit to U.S. Provisional Application Ser. No. 60/751,864 filed Dec. 20, 2005.

FIELD OF THE INVENTION

The present invention relates generally to methods and devices that give a fluid stream the appearance of being lighted.

BACKGROUND OF THE INVENTION

There are numerous known methods of object coloring by a conventional filtered light source. The most common is theatrical lighting, where a powerful incandescent lamp, strategically positioned inside of the reflector, shines the light onto the object through a colored diffuser. The same principle is used in flashlights, regardless of the lamp type. A disadvantage with these devices, and the principles under which they perform, is they color only the surface to which they are pointed. If there is a need to cover a large object, a stronger light or multiple light beams are needed.

When it comes to other objects, such as moving transparent fluids, e.g., water, the refractory properties of these objects are different from those of solid objects. Consequently, the known methods are neither practical nor perform to a reasonable satisfaction when it comes to lighting these objects. In addition, none of the known devices are capable of uniformly coloring the moving fluid along the flow direction. Moreover, customer demand for aesthetically pleasing optically enhanced static or dynamic fluids creates a need in the art for a low-cost, low-energy, compact device to provide water stream coloring in devices such as common household appliances and fixtures.

The present invention addresses these and other drawbacks with known lighting systems.

SUMMARY OF THE INVENTION

In one aspect, the present invention is directed to devices and systems configured and adapted to give a fluid stream the appearance of being lighted. Different colors of light, such as those provided from light emitting diodes (LEDs), may be used to generate the optical illusion of flowing colored fluid, which is aesthetically appealing and creates a variety of moods, such as relaxing or celebratory.

In some embodiments, the fluid illumination may be accomplished by a light source directed towards a fluid stream from an external angle. Alternatively, the light source may be aligned in the direction of the fluid stream, lighting it substantially internally. In yet other embodiments, the fluid illumination may be enhanced with the employment of reflective surfaces that bounce light around and through the fluid stream. In alternative aspects, the fluid surface area may be increased by generating turbulent flow, which increases the appearance of the fluid being lighted due to the generation of additional reflective fluid surfaces in the turbulent flowing stream. In one aspect, the turbulent flow may be achieved with the use of a separator to separate a single fluid stream into a plurality of micro-streams.

Other features and advantages of the invention will become apparent to those skilled in the art upon review of the following detailed description, claims and drawings in which like numerals are used to designate like features.

DETAILED DESCRIPTION OF THE EMBODIMENTS

The present invention may be embodied in many forms. Referring to the Figures, there are depicted various aspects of the invention. In one aspect, the invention is a device adapted to give a water stream, such as that dispensed from a refrigerator, for example, the appearance of being lighted. Although water is discussed, the invention is capable of use with any transparent or nontransparent fluid or fluid material. A feature of the invention is to illuminate the stream of water as it travels from a dispenser to a receptacle, for example a cup.

The surface of water acts as a reflector of light when it has a greater index of refraction, or density, than another material such as air. Since light from an outside source generally reflects off the surface of the water back into the air, an increase in surface area will intensify the optical effect. Moreover, water tends to act as a piping mechanism when light is introduced into the interior regions of a water stream, making a fiber optic by carrying light down the water stream's axis and emitting very little light normal to the outer surface. By inducing turbulence, it is possible to disrupt the surface of the water, thus decreasing the uniform specularity of the reflector (water) and causing a randomization of the light reflecting from the air to water interface. This randomization of light counteracts the piping property of any light within the stream and gives the water its desired reflective property. Turbulence may be induced in a water stream by a separator, which is an orifice like device similar in structure to a shower head that takes a large stream of water and separates it into a plurality of smaller streams. The generation of the plurality of streams greatly increases the surface area, and thus light reflection, of the water.

In another aspect, light may travel through a medium, such as plastic, and then into water. The plastic will generally have a density that is either lower than or higher than the density of water. In the case of plastic having a lower density than water, the light will have a tendency to stay within the water stream. Also, the light will mainly stay within the water stream when it travels through the air, illuminating the water. In general, however, it is common for most plastics to have a higher density than water. In this case, light will have a tendency to leave the water and transfer back to the plastic.

Figure 1:
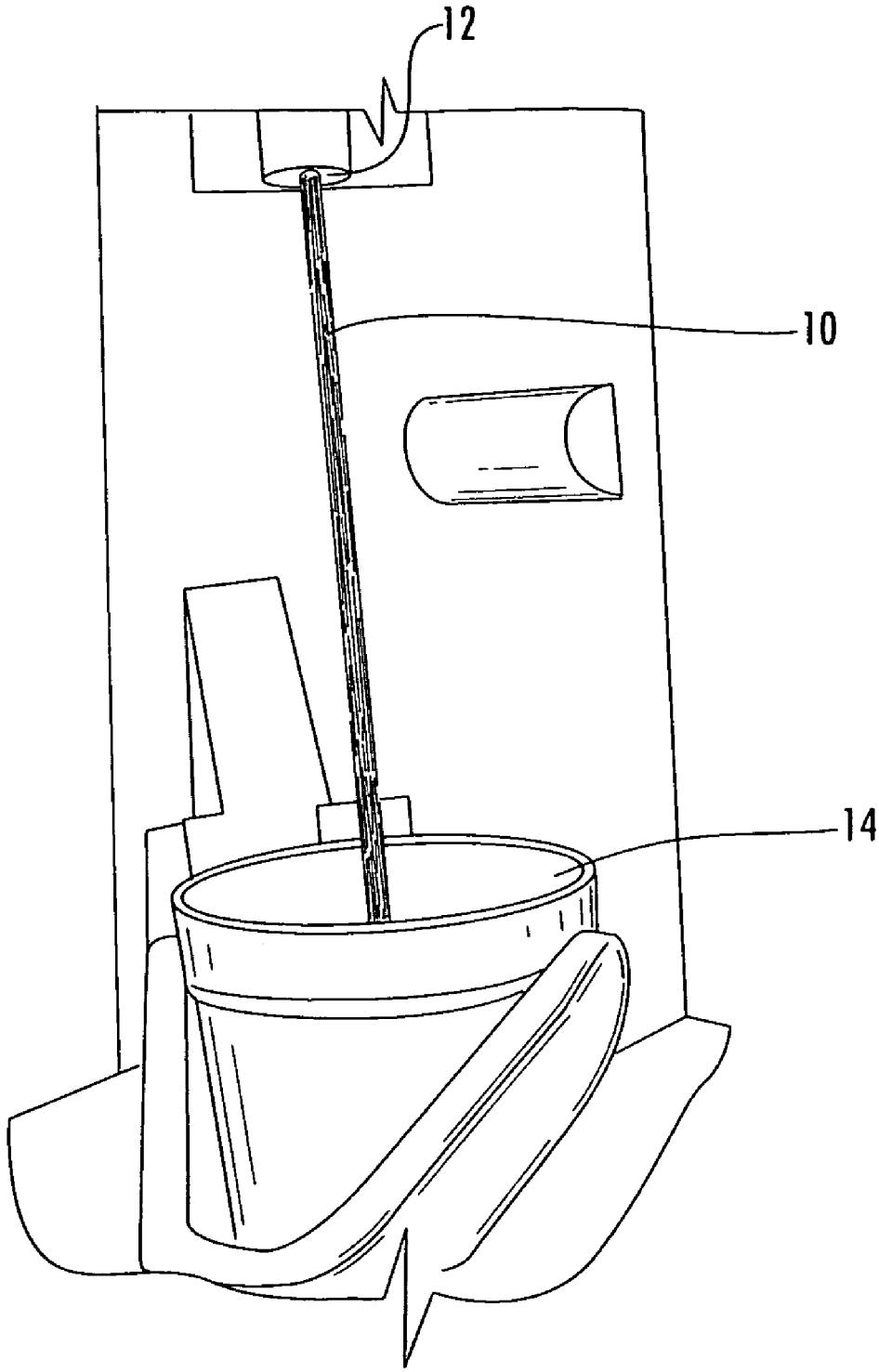
FIG. 1 illustrates an embodiment wherein a fluid travels in a single lighted stream in accordance with the principles of the invention.

Referring to FIG. 1, a water stream 10 lighted by a device or techniques of the invention is illustrated. The water stream 10 may flow out of a dispenser 12 from a refrigerator, for example, and into a receptacle 14, for example. It should be understood that the dispenser 12 is exemplary of the numerous types of dispensers or devices that dispense a fluid and that may be used with the lighting techniques of the invention, and that a refrigerator is exemplary of the various applications of the invention. Other contemplated applications include other household appliances or fixtures, such as lighted shower streams, water faucets, tabletop illuminated fountains, illuminated cocktail glasses, to name a few.

Figure 2:
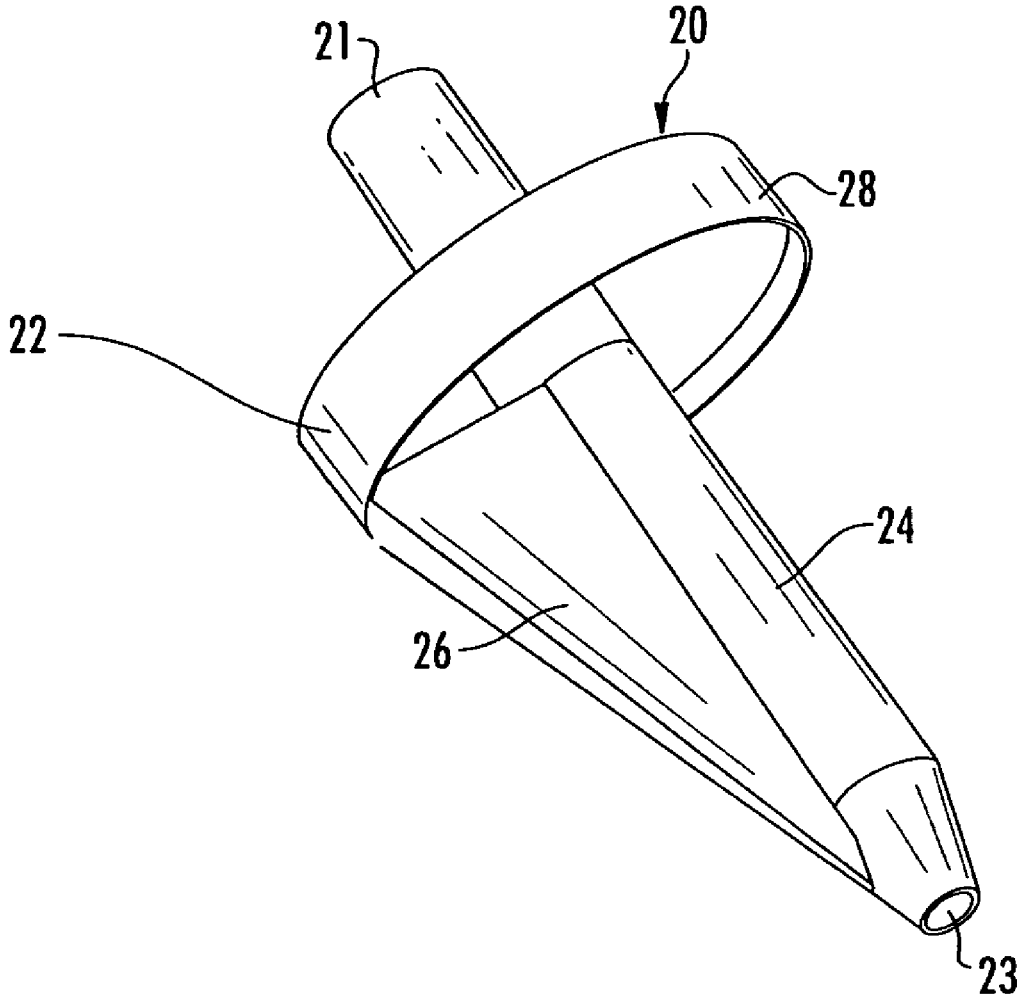
FIG. 2 illustrates an LED or light holding device for use in conjunction with a stream of fluid in accordance with an embodiment of the invention.

Referring to FIG. 2, an exemplary water illuminating device 20 of an embodiment of the invention is depicted. The water illuminating device 20 may be mounted on an upper end 21 of a transparent tube 24 to a source of water, such as a refrigerator drinking water line. As water flows into device 20 and through the transparent tube 24, an LED 22 (generally depicted) or other suitable light source, disposed on a support 28 at a distance from, and normal to, the tube 24, provides light that is directed into the water stream at an angle by a light director 26. The light director 26 comprises a concave reflective surface that in an aspect may form generally a cone-shaped configuration, attached along the wide end of the cone to the support 28 and along the narrow end of the cone to the lower end 23 of the device, surrounding at least in part the transparent water tube 24. The cone-shaped light director may also completely surround the water tube 24. The light director 26 may comprise any acceptable material, such as a metal, provided that it includes a reflective surface, and functions by reflecting any stray light rays back towards the water stream 10 before it is dispensed through the lower end 23 of the device 20. With the device 20, the fluid that exits the tube 24 will have the desired illuminated effect. While an LED is described as the light source, any other suitable light source may be used with the invention. It should be further understood that the number, size and color of LEDs may vary depending on the application and the desired lighting effect. Additionally, other shapes and configurations of the light director are possible to direct light emitted by the LEDs back into and through the fluid stream.

Figure 3:
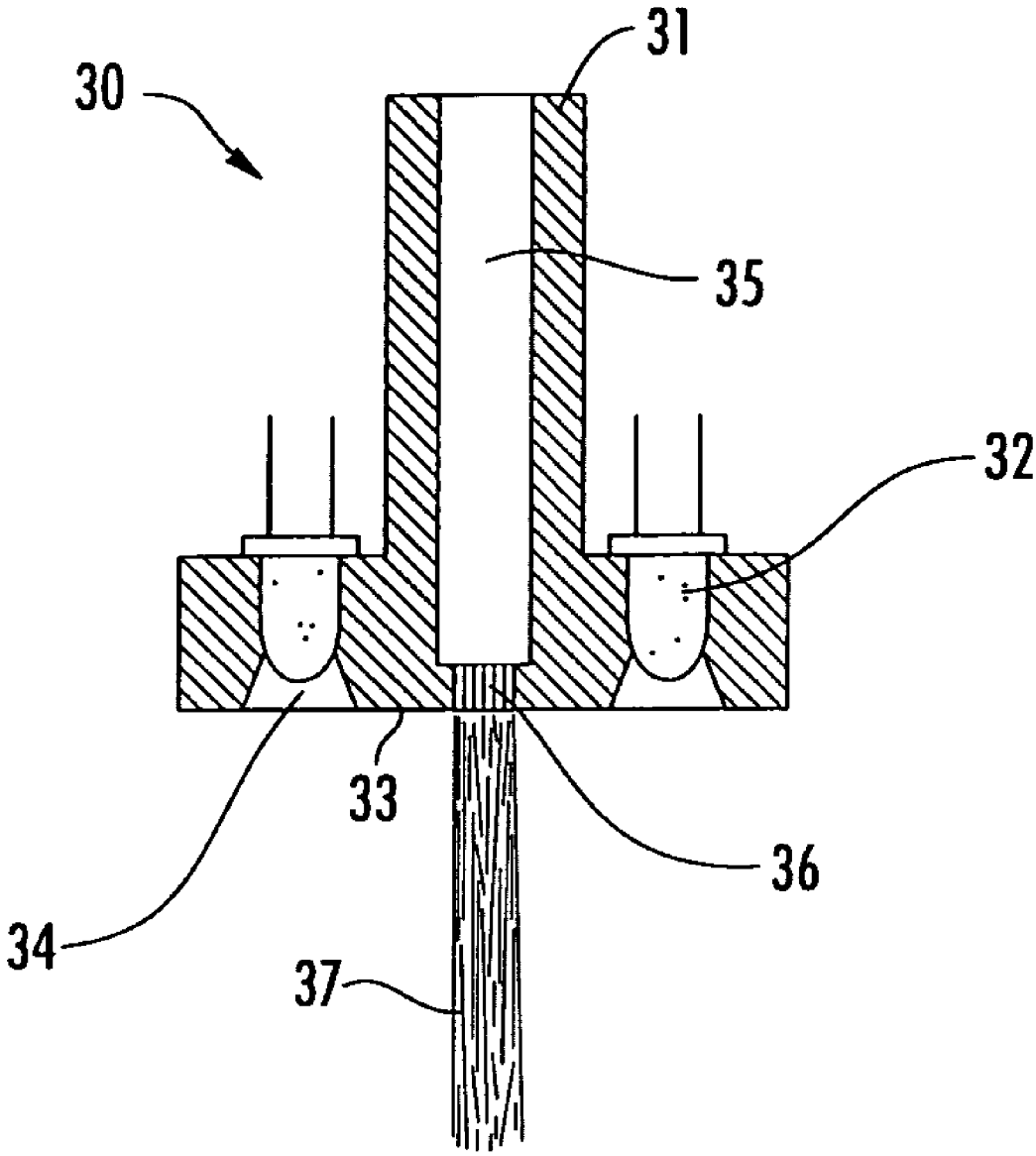
FIG. 3 illustrates an exterior light source device comprising two LED holders with reflectors, and a fluid separator in accordance with an embodiment of the invention.

Referring to FIG. 3, another aspect of the invention provides separation of a single fluid stream into a plurality of micro-streams 37, as illustrated in device 30. The separation is performed to create a greater illuminating effect than possible with a single fluid stream. The device includes a body 33, an external light source such as LED 32, and in some aspects, two LEDs with conical reflectors 34 disposed at the lower end of the device 33. Fluid, for example water, is caused to flow into the device 30 through an upper end 31, through a generally vertical tube 35 and into a separator 36 disposed at the lower end of the device 33. The separator 36 may comprise either a plastic or metal material, for example, or a combination thereof. The separator 36 operates to divide the water stream via any suitable technique. In an aspect of the invention, the separator 36 may comprise a plurality of generally parallel vertical channels, each having a substantially smaller diameter than that of tube 35, to create turbulent flow by separating the water from a single stream into a plurality of micro-streams 37. The micro-streams have a greater combined surface area than the single water stream and thus will provide a greater illumination effect. In operation, light provided by the LEDs 32 is directed at the micro-streams 37, both directly from the LEDs 32 and via reflection of stray light rays by the reflectors 34. The light reflects off the micro-stream 37 surfaces, generating the appearance of illumination of the water. The device 30 may be used in any of the applications described herein.

Figure 4:
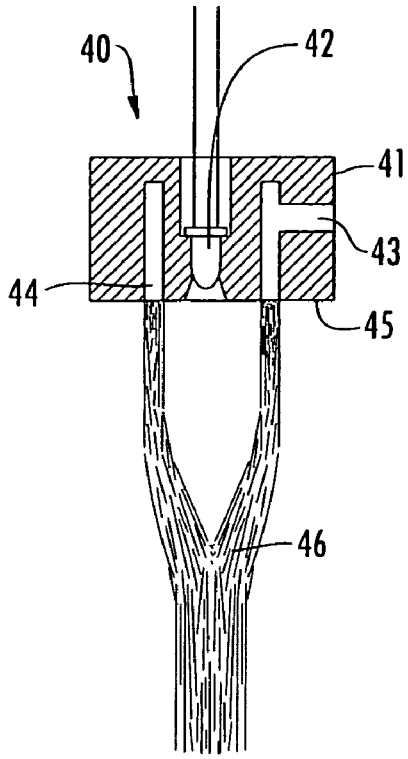
FIG. 4 illustrates a cross-section view of an internal light source device comprising an LED holder and a cylindrical fluid dispenser in accordance with an embodiment of the invention.

Referring to FIG. 4, a cross-section view of another embodiment of the invention includes a device 40 that combines the features of an intenial light source LED 42 to illuminate a flowing fluid, such as water, and a cylindrical output 44 to create turbulent flow. In contrast to devices 20 and 30, described above, water is caused to flow into device 40 from a side entrance 41 and through a generally horizontal tube 43 into the cylindrical output 44. The water exits device 40 from a lower end 45, forming the shape of the walls of a cylinder. LED 42 is disposed central to the cylindrical output 44. In this position, the LED 42 will direct light at the interior of the turbulent water flow 46 as it is dispensed, thereby illuminating the water.

Figure 5:
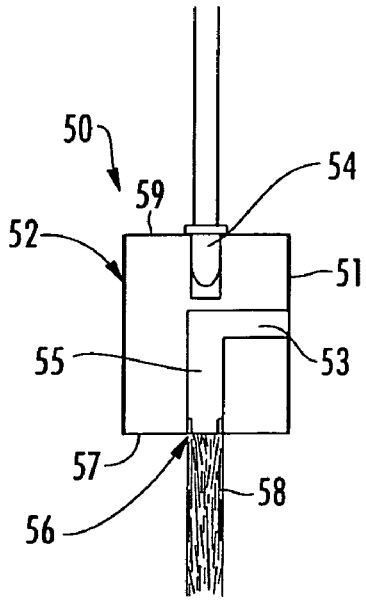
FIG. 5 illustrates a coaxial light source device comprising a transparent LED holder, light shields, and a fluid separator in accordance with an embodiment of the invention.

Referring to FIG. 5, another embodiment of the invention relates to a coaxial light source. Device 50 includes a clear or transparent body, such as formed by a material comprised of acrylic, and reflective shields 52 preferably made of black material disposed along the sides of the device 50 (or around the periphery of the device 50) to bounce light beams back and forth within the clear body of the device 50. A fluid, such as water, is caused to flow into device 50 from a side 51 and through an L-shaped tube formed by portions 53 and 55. The generally horizontal portion 53 is in fluid communication with the generally vertical portion 55 of the tube. The vertical portion 55 directs the flow of water into a separator 56 disposed at the lower end 57 of device 50. The separator 56 may comprise a plurality of generally parallel vertical channels, each having a substantially smaller diameter than that of vertical portion 55 of the tube to create turbulent flow by separating the water from a single stream into a plurality of micro-streams 58. An LED 54 may be disposed at the upper end 59 of device 50 directly above vertical portion 55 of the tube to provide light in the direction of the water flow. The light from LED 54 on the water stream and the plurality of micro-streams 58 formed by and descending from the separator 56, combined with the rays of light that may bounce throughout the transparent body of device 50 by the reflective shield 52, provide the appearance of illumination of the dispensed water. Again, as with all the embodiments, while an LED is described as the light source, any other suitable light source may be used and the number, size and color of LEDs may vary depending on the application and the desired lighting effect. Also, other shapes and configurations of the reflective shield are possible to direct light emitted by the LEDs back into and through the fluid stream.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A device to light a stream of fluid comprising:

a transparent tube disposed between an upper and a lower end, in communication with a fluid source at the upper end and open at the lower end to allow a stream of fluid to exit the device;

a light source mounted on a support at a distance from, and normal to, the transparent tube to provide light directed at the fluid in the tube; and a light director disposed behind the light source to reflect light towards the fluid in the transparent tube, the light director including a concave reflective surface that extends toward the lower end of the tube, wherein the light director defines a cone-shaped configuration further defining a wide end mounted to the support and a narrow end mounted to the lower end of the tube, the light director configured to surround at least a portion of the tube.

2. The device of claim 1 wherein the light source comprises an LED.

3. The device of claim 2 wherein the fluid comprises water.

4. The device of claim 1 further comprising a separator disposed at the open end of the tube at the lower end of the device to separate the fluid stream into a plurality of fluid micro-streams to substantially increase the surface area of the fluid exiting the device.

5. The device of claim 4 wherein the separator defines a plurality of generally parallel channels.

6. The device of claim 5 wherein the plurality of generally parallel channels and vertical and each have a substantially smaller diameter than that of the tube.

7. A device to light a stream of fluid comprising:

a transparent tube disposed between an upper and a lower end, in communication with a fluid source at the upper end and open at the lower end to allow a stream of fluid to exit the device;

a light source mounted on a support at a distance from the transparent tube to provide light directed at the fluid in the tube; and a light director disposed behind the light source to reflect light towards the fluid in the transparent tube, the light director including a concave reflective surface that extends toward the lower end of the tube, wherein the light director defines a cone-shaped configuration further defining a wide end mounted to the support and a narrow end mounted to the lower end of the tube, the light director configured to surround at least a portion of the tube.

* * * * *